US006374897B1

(12) United States Patent
Liu

(10) Patent No.: US 6,374,897 B1
(45) Date of Patent: Apr. 23, 2002

(54) ROLLING STEEL DOOR

(76) Inventor: Kuei-Chang Liu, 43-07 Crommelin Ave., Flushing, NY (US) 11355-4914

( * ) Notice: Subject to any disclaimer, the term of this patent is extended or adjusted under 35 U.S.C. 154(b) by 0 days.

(21) Appl. No.: 09/678,393

(22) Filed: Oct. 3, 2000

(51) Int. Cl.[7] ..... E06B 3/12
(52) U.S. Cl. ..... 160/236; 160/133; 160/229.1
(58) Field of Search ..... 160/133, 229.1, 160/236; 59/6, 15, 84, 87, 91

(56) References Cited

U.S. PATENT DOCUMENTS 2,095,690 A * 10/1937 Brunst
2,310,016 A * 2/1943 Doberstein
2,525,724 A * 10/1950 Robbins
2,940,520 A * 6/1960 Cookson, Jr. et al.
3,601,175 A * 8/1971 Wardlaw
3,850,465 A * 11/1974 Hill et al.
6,189,593 B1 * 2/2001 Katchur et al.
6,240,997 B1 * 6/2001 Lee

* cited by examiner

*Primary Examiner*—Blair M. Johnson
(74) *Attorney, Agent, or Firm*—Rosenberg, Klein & Lee

(57) ABSTRACT

A link for rolling steel door link formed of a body and a cover plate covered on the body, the body having two short coupling tubes and a peripheral flange at one side, the cover plate having two coupling holes respectively coupled to the coupling tubes of the body and a peripheral flange abutted against the peripheral flange of the body, the end of each short coupling tube being expanded by a punch press to fixedly secure the cover plate to the body after its insertion through the respective coupling hole on the cover plate.

3 Claims, 7 Drawing Sheets

ROLLING STEEL DOOR

BACKGROUND OF THE INVENTION

The present invention relates to a rolling steel door, and more particularly to a light structure of rolling steel door, which needs less storage space when rolled up.

FIGS. 6 and 7 show a rolling steel door according to the prior art. This structure of rolling steel door comprises a plurality of solid metal transverse rods 2, a plurality of sleeves respectively sleeved onto the metal transverse rods 2, and a plurality of links 3 respectively coupled to the metal transverse rods 2 to hold the metal transverse rods in parallel. The links 3 are respectively formed of two symmetrical half shells 31. Each link 3 has two coupling holes 311 disposed at two distal ends, and respectively coupled to a respective metal transverse rod 2. Because each link 3 is formed of two symmetrical half shells 31, the coupling holes 311 have a certain depth, i.e., each link 3 has a broad contact area adapted to support the metal transverse rods 2. Further, in order to diminish the weight, the metal transverse rods 2 have a hollow structure. However, this structure of rolling steel door still has drawbacks as outlined hereinafter.

1. Because the links 3 are respectively formed of two symmetrical half shells 31, the links 3 are less stable when taking up or letting off the rolling steel door, resulting in high noise.

2. Because the links 3 are respectively formed of two symmetrical half shells 31, the coupling holes of the respective pair of half shells 31 may be not perfectly aligned, causing the links 3 unable to keep the metal transverse rods 2 in parallel perfectly.

3. Because the links 3 are respectively formed of two symmetrical half shells 31, it is complicated to install the links 3.

SUMMARY OF THE INVENTION

The present invention has been accomplished to provide links for rolling steel door, which eliminates the aforesaid drawbacks. It is one object of the present invention to provide a link for rolling steel door, which has high strength. It is another object of the present invention to provide a link for rolling steel door, which produces less noise during the operation of the rolling steel door. It is still another object of the present invention to provide a link for rolling steel door, which facilitates the assembly of the rolling steel door. It is still another object of the present invention to provide a link for rolling steel door, which causes a sense of beauty. According to one embodiment of the present invention, the link is formed of a body and a cover plate covered on the body. The body comprises two short coupling tubes, and a peripheral flange at one side. The cover plate comprises two coupling holes respectively coupled to the coupling tubes of the body, and a peripheral flange abutted against the peripheral flange of the body. The end of each short coupling tube is expanded by a punch press to fixedly secure the cover plate to the body after its insertion through the respective coupling hole on the cover plate. According to an alternate form of the present invention, the body has two coupling holes, which receive the short coupling tubes respectively. After inserted through the coupling holes of the body, the short coupling tubes are respectively expanded by a punch press, and therefore the short coupling tubes and the body are fixedly fastened together.

DETAILED DESCRIPTION OF THE PREFERRED EMBODIMENT

Figure 1:
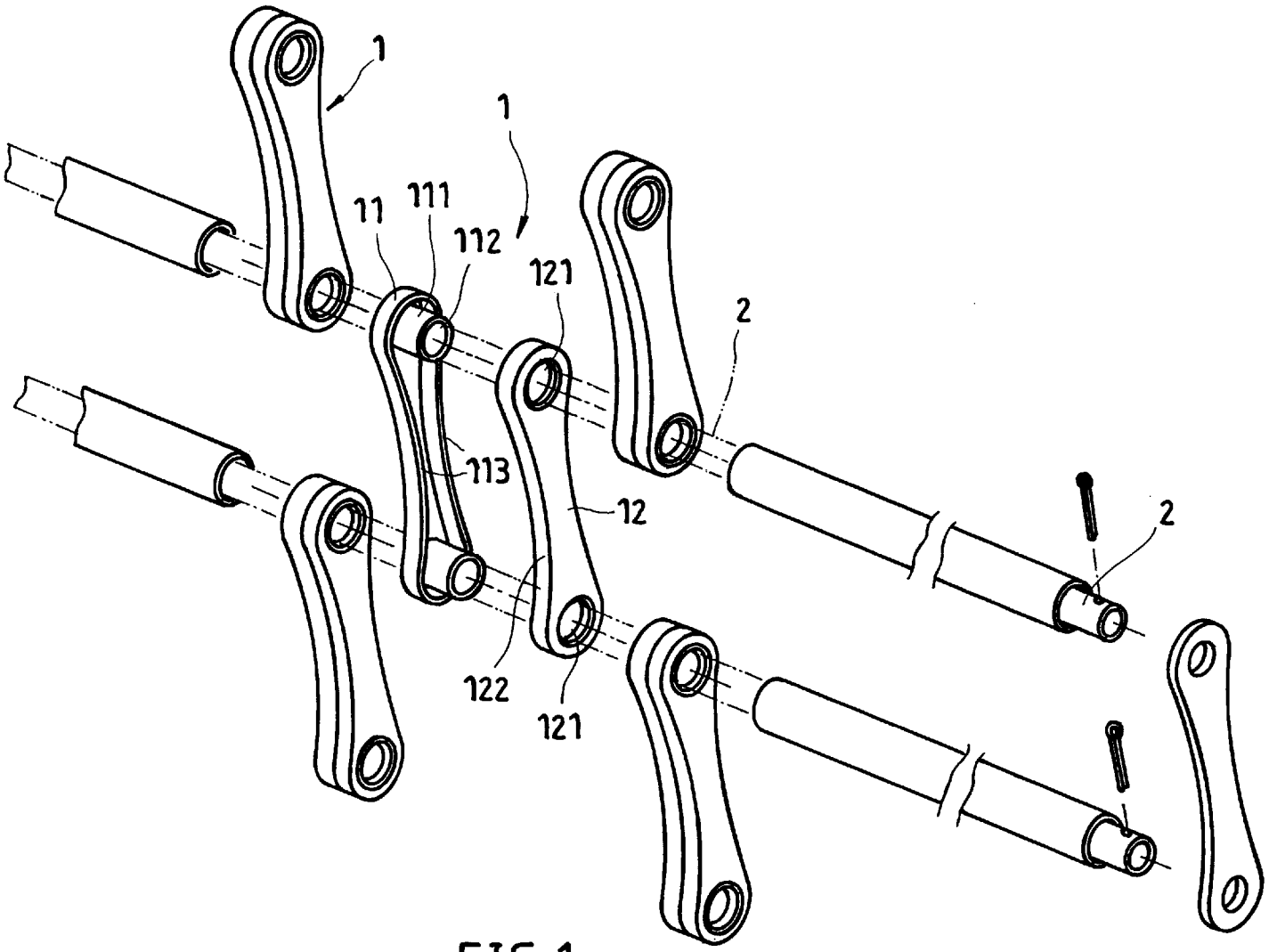
FIG. 1 is an exploded view of a part of a rolling steel door constructed according to the present invention.
Figure 2:
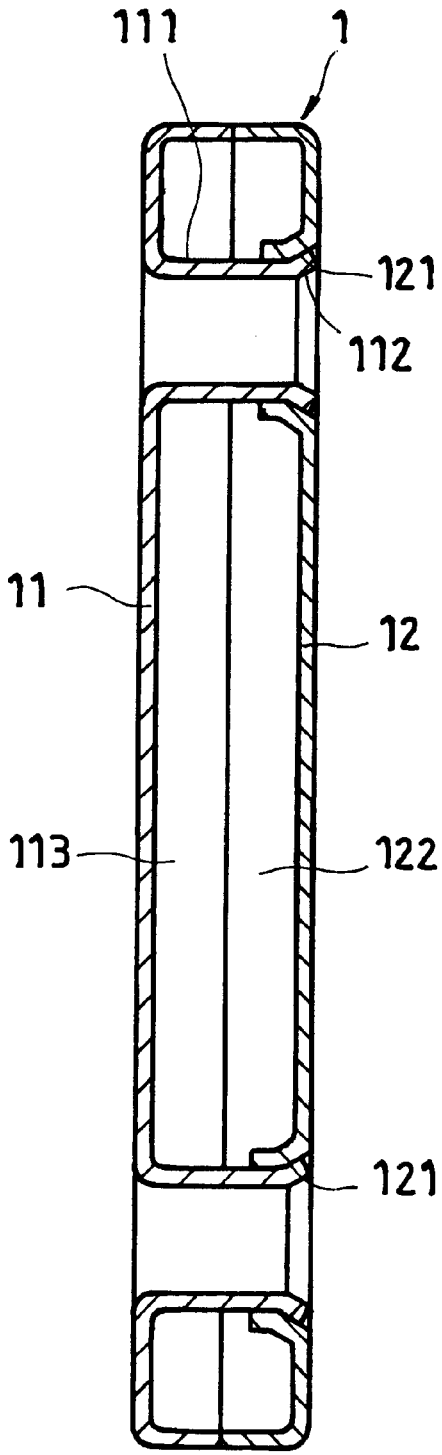
FIG. 2 is a sectional view of a link for the rolling steel door constructed according to the present invention.
Figure 3:
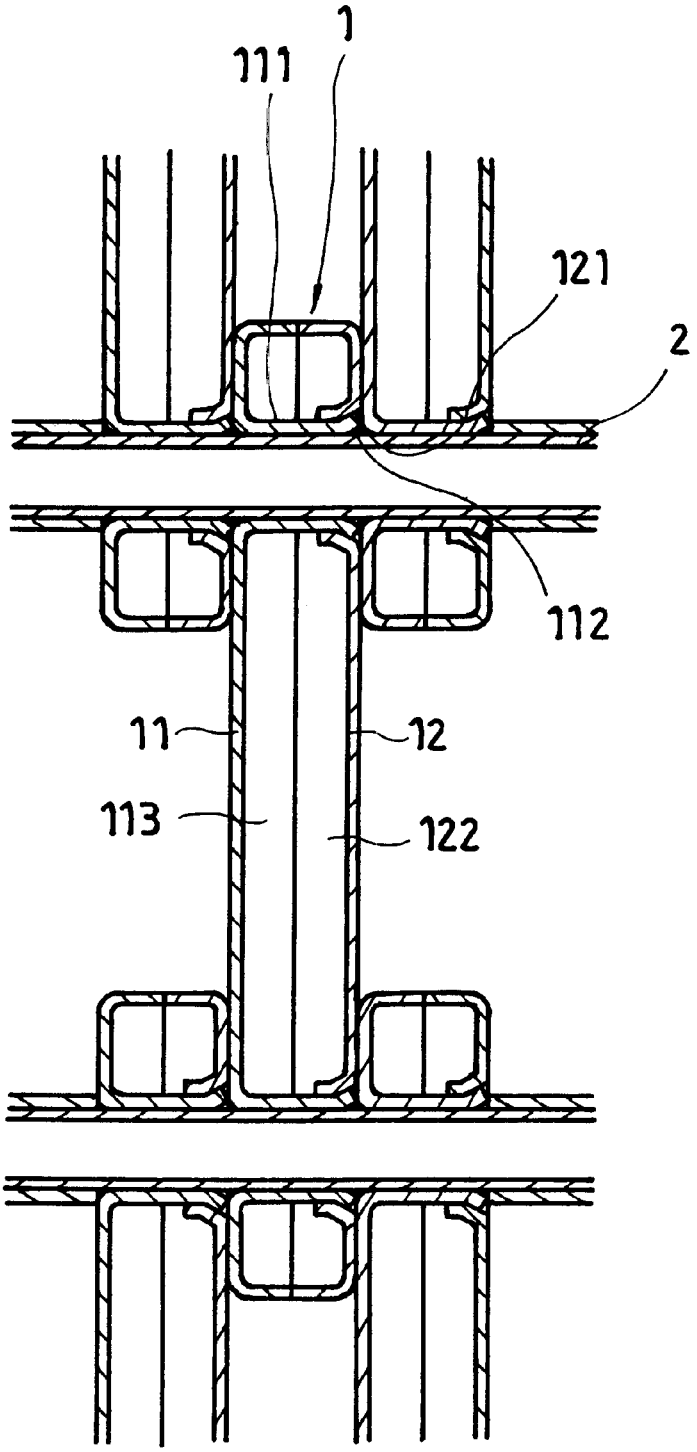
FIG. 3 is a sectional assembly view of a part of the rolling steel door constructed according to the present invention.

Referring to FIGS. from 1 through 3, a rolling steel door according to the present invention is shown comprised of a plurality of transverse tubes 2, and a plurality of links 1 respectively coupled to the transverse tubes 2 to hold the transverse tubes 2 in parallel. The links 1 are respectively comprised of a body 11 and a cover plate 12 covered on the body 11. The body 11 and the cover plate 12 are respectively made of metal by stamping. The body 11 comprise two coupling tubes 112 perpendicularly projecting from an inner side thereof near two distal ends, and a peripheral flange 113 perpendicularly extended from the border area of the inner side. The cover plate 12 comprises two coupling holes 121 disposed near two distal ends thereof and respectively coupled to the coupling tubes 111 of the body 11, and a peripheral flange 122 perpendicularly extended from the border area of the inner side thereof and abutted against the peripheral flange 113 of the body 11. After the coupling tubes 111 of the body 11 had been respectively inserted through the coupling holes 121 of the cover plate 12, the end 112 of each coupling tube 111 is expanded by a punch press, causing the cover plate 12 to be fixedly secured to the body 11.

Figure 4:
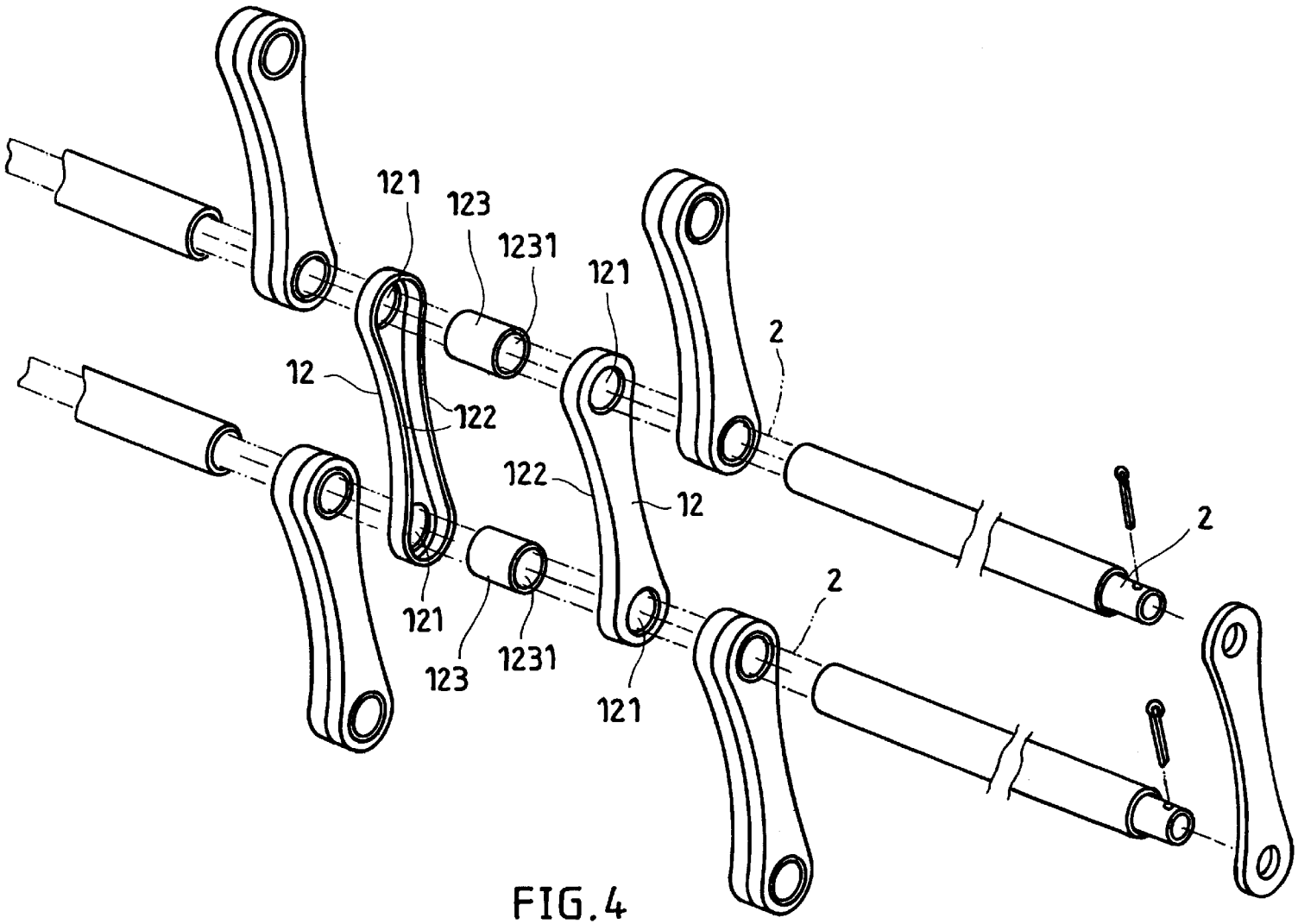
FIG. 4 is an exploded view of a part of an alternate form of the rolling steel door according to the present invention.
Figure 5:
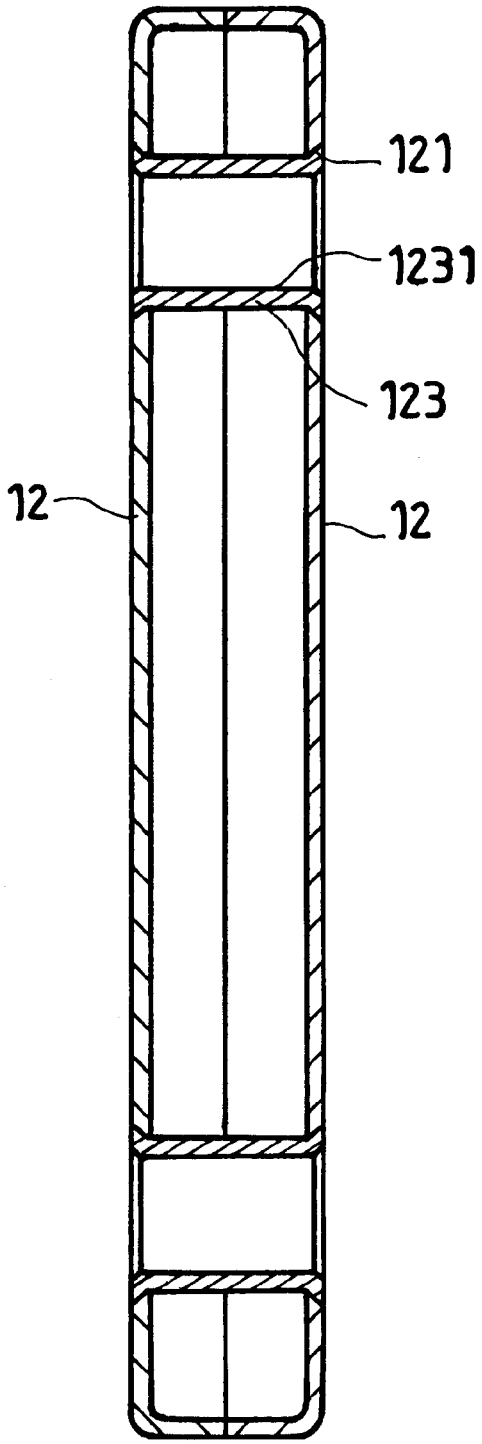
FIG. 5 is a sectional view of the alternate form of the link according to the present invention.
Figure 6:
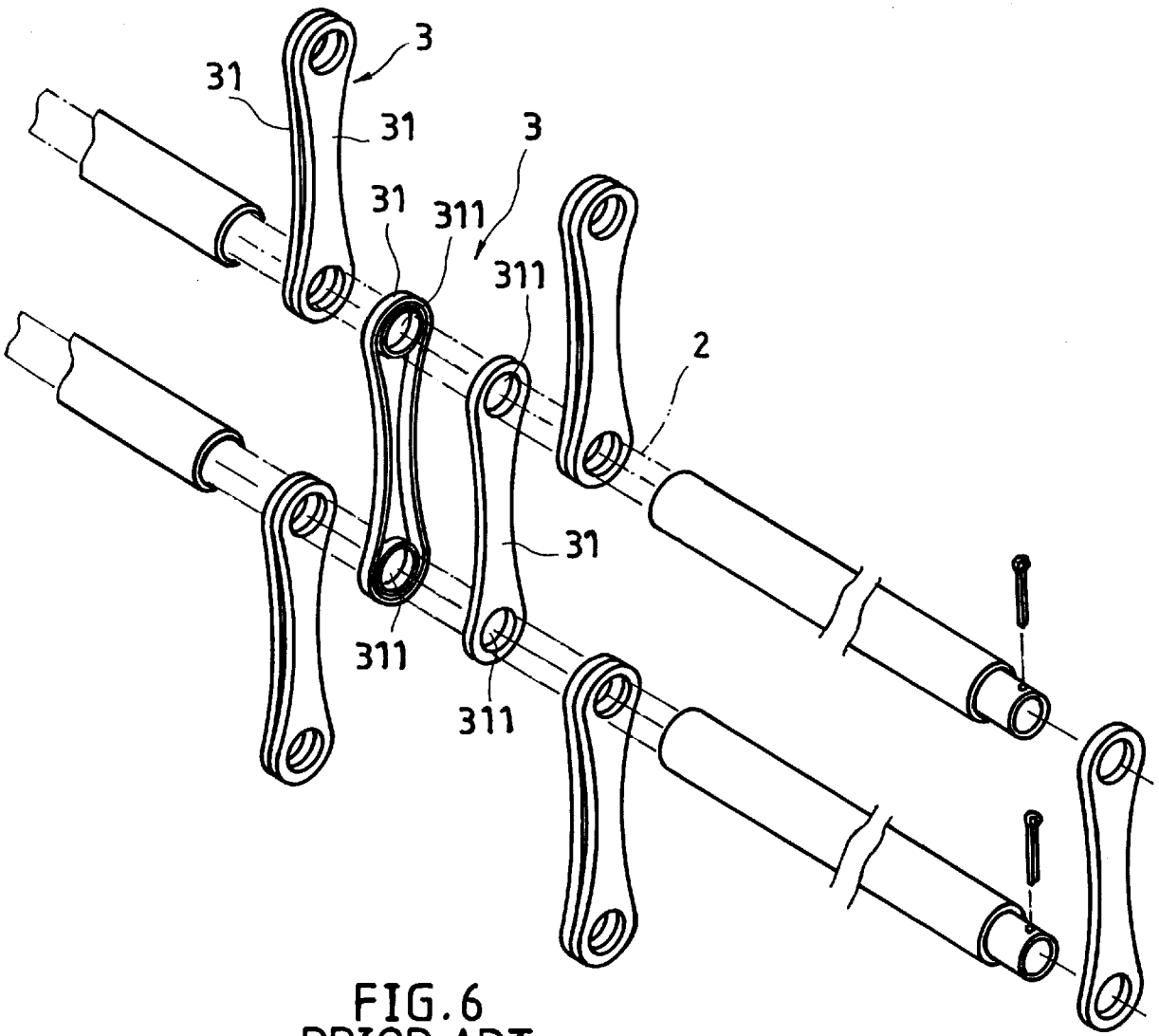
FIG. 6 PRIOR ART
FIG. 6 is an exploded view of a part of a rolling steel door according to the prior art.
Figure 7:
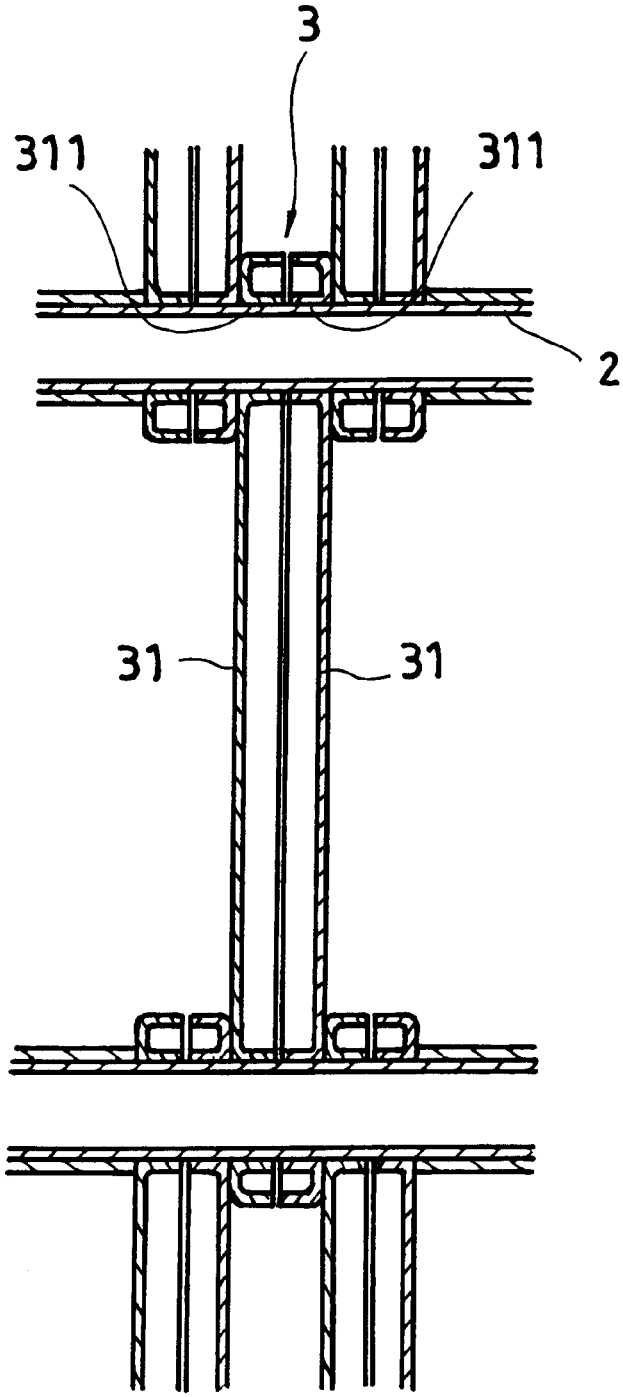
FIG.7 PRIOR ART
FIG. 7 is a sectional assembly view of a part of the prior art rolling steel door shown in FIG. 6.

FIGS. 4 and 5 show an alternate form of the present invention. According to this alternate form, the body is formed with a configuration identical to that of a cover plate, such that each link comprises two cover plates 12, and two short coupling tubes 123 connected between the cover plates 12. Each cover plate 12 comprises two coupling holes 121 disposed near two distal ends thereof, and a peripheral flange 122 perpendicularly extended from the border area thereof at one side. When two cover plates 12 are attached together, the peripheral flange 122 of one cover plate is abutted against the peripheral flange of another, and then the short coupling tubes 123 are respectively inserted through the coupling holes 121 of the cover plates 12, and then the two distal ends 1231 are respectively expanded by a punch press to secure the cover plates 12 fixedly together. In certain embodiments, the two distal ends 1231 of each short coupling tube 123 are respectively welded to the periphery of the coupling holes of the opposing cover plates.

It is to be understood that the drawings are designed for purposes of illustration only, and are not intended as a definition of the limits and scope of the invention disclosed.

What the invention claimed is:

1. A link for a rolling steel door comprising a body, said body comprising an inner side and a peripheral flange perpendicularly extended from a border area of said inner side, a cover plate covered on said body, said cover plate comprising two coupling holes disposed near two distal ends thereof and a peripheral flange perpendicularly extended from the border area of one side thereof and abutted against the peripheral flange of said body, and two short coupling tubes adapted to fixedly secure said body and said cover plate together, said short coupling tubes each having a first end fixedly connected to said body and a second end inserted through the coupling holes of said cover plate and expanded by a punch press to secure said cover plate to said body.

2. The link of claim 1 wherein said body further comprises two coupling holes near two distal ends thereof, and the first end of each of said short coupling tubes is respectively inserted through the coupling holes of said body and expanded by a punch press to fixedly secure said body and said short coupling tubes together.

3. The link of claim 2 wherein the first and second end of each of said short coupling tubes are respectively welded to the periphery of the coupling holes of said body and said cover plate.

* * * * *